US008800834B2

(12) United States Patent
Pedicini et al.

(10) Patent No.: US 8,800,834 B2
(45) **Date of Patent: *Aug. 12, 2014**

(54) FASTENER DRIVING APPARATUS

(75) Inventors: Christopher Pedicini, Nashville, TN (US); John Witzigreuter, Canton, GA (US)

(73) Assignee: Tricord Solutions, Inc., Nashville, TN (US)

( * ) Notice: Subject to any disclaimer, the term of this patent is extended or adjusted under 35 U.S.C. 154(b) by 516 days.

This patent is subject to a terminal disclaimer.

(21) Appl. No.: 13/179,318

(22) Filed: Jul. 8, 2011

(65) Prior Publication Data

US 2012/0286014 A1 Nov. 15, 2012

Related U.S. Application Data

(63) Continuation-in-part of application No. 13/104,996, filed on May 11, 2011, now Pat. No. 8,079,504.

(51) Int. Cl.
*B25C 1/04* (2006.01)

(52) U.S. Cl.
USPC ..... 227/2; 227/10; 227/130; 60/370

(58) Field of Classification Search
USPC ..... 227/8, 9, 10, 130, 131, 2; 173/124, 205, 173/109; 60/370, 387; 91/417 A, 417 R
See application file for complete search history.

(56) References Cited

U.S. PATENT DOCUMENTS

| | | | | | |
|---|---|---|---|---|---|
| 1,829,609 | A | * | 10/1931 | Robinson | 173/201 |
| 3,397,828 | A | * | 8/1968 | Volkmann | 227/130 |
| 3,434,393 | A | * | 3/1969 | Cairatti | 91/417 A |
| 3,568,780 | A | * | 3/1971 | Matsuo | 173/201 |
| 3,580,458 | A | * | 5/1971 | Monacelli | 227/124 |
| 3,602,103 | A | * | 8/1971 | Powers | 91/443 |
| 3,821,992 | A | * | 7/1974 | Matsuo | 173/200 |
| 4,033,419 | A | * | 7/1977 | Pennington | 173/34 |
| 4,344,555 | A | * | 8/1982 | Wolfberg | 227/130 |
| 6,843,401 | B2 | * | 1/2005 | Favre-Bulle | 227/10 |
| 7,419,079 | B2 | * | 9/2008 | Chen et al. | 227/130 |
| 7,793,811 | B1 | * | 9/2010 | Pedicini et al. | 60/370 |
| 8,079,504 | B1 | * | 12/2011 | Pedicini et al. | 227/2 |

* cited by examiner

*Primary Examiner* — Scott A. Smith
(74) *Attorney, Agent, or Firm* — Jay Schloff; Aidenbaum Schloff and Bloom PLLC

(57) ABSTRACT

A fastener driving apparatus includes a power source, a control circuit, a motor, a first cylinder, a first piston, a linear motion converter, a second cylinder, a second piston, an anvil, a retention element retaining a component of the apparatus, and at least one sensor. During a compression stroke, the first piston compresses gas in a first cylinder to a predetermined pressure. Compressed gas is communicated to the second cylinder and the retention force of the retention element is overcome, to release the retained component of the apparatus, thereby causing the second piston to move linearly and enabling the anvil to drive the fastener into the workpiece. During a return stroke of the first piston, a vacuum created in the first cylinder is communicated to the second cylinder, causing, along with an optional other retraction capacity, the second piston and the anvil to retract to their initial positions.

20 Claims, 6 Drawing Sheets

FASTENER DRIVING APPARATUS

CROSS REFERENCE TO RELATED APPLICATIONS

The present disclosure is a continuation in part of the U.S. Utility patent application Ser. No. 13/104,996 filed on May 11, 2011 now U.S. Pat. No. 8,079,504. the disclosure of which is incorporated by reference.

FIELD OF THE DISCLOSURE

The present disclosure generally relates to apparatuses for driving fasteners into workpiece, and more particularly, to a fastener driving apparatus used as a portable hand tool.

BACKGROUND OF THE DISCLOSURE

A fastener driving apparatus is a tool used to drive fasteners, such as nails and staples into a workpiece. The fastener driving apparatus may be used for various operations, such as making wooden walls, positioning hang sheathings over the wooden walls, fastening baseboards over a lower portion of an interior wall and crown molding.

There are various fastener driving apparatuses known in the art. These fastener driving apparatuses operate utilize various means and mechanisms known in the art for their operation. For example, the prior art fastener driving apparatuses may be operated based on compressed air generated by an air compressor, fuel cells, electrical energy, a flywheel mechanism, and the like.

Although these fastener driving apparatuses are useful in driving the fasteners into the workpiece, such apparatuses have numerous limitations. For example, the fastener driving apparatuses operated on the compressed air are bulkier, non-portable and costlier due to requirement of the air compressor and associated air-lines. Fastener driving apparatuses operated on the fuel cells are complicated in design and are expensive. Further, the apparatuses that are operated on the fuel cells require both electrical energy and fuel. More specifically, a spark source required for combustion of the fuel derives its energy from various electric energy sources such as batteries, and the like. Furthermore, the fastener driving apparatuses operated on the fuel cells generate loud report and release of combustion products.

Further, the fastener driving apparatuses operated on the electrical energy are limited to fasteners of relatively small lengths, such as one inch or less. Further, the fastener driving apparatuses operated on the electrical energy generate high reactionary force. The high reactionary force is a consequence of the comparatively longer time taken by such fastener driving apparatuses to drive the fasteners into the workpiece. Further, the fastener driving apparatuses operated on the electrical energy are limited in their repetition rate because of long time it takes to drive a fastener into the work piece. Moreover, although fastener driving apparatuses operated by flywheels are capable of driving the fasteners of longer sizes very quickly, these apparatuses are bulkier in sizes and weight. Further, drive mechanisms of these apparatuses are complicated in design, which results in a high cost of such apparatuses.

Additionally, a majority of the above-mentioned fastener driving apparatuses includes a striker mechanism for driving the fasteners into the workpiece. The striker mechanism may be retracted to its initial position by means of various retracting mechanisms, such as a spring, a bungee and the like. Although such striker mechanisms are useful in driving the fasteners into the workpiece, these retracting mechanisms have numerous limitations. For example, the retracting mechanisms, due to inertia associated therewith, consume significant drive energy of the fastener driving apparatuses and may prevent the fasteners from being fully driven into the workpiece. Accordingly, these retracting mechanisms may require an increase in power to drive the fasteners into the workpiece. Further, these retracting mechanisms reduce drive speed of the fastener driving apparatuses. Furthermore, the existing retracting mechanisms may bias the striker mechanism towards the workpiece, causing a safety hazard for the user.

Based on the foregoing, there exists a need for a portable fastener driving apparatus that has an improved safety profile and that efficiently drives a fastener in a single stroke with favorable ergonomics. The fastener driving apparatus should have a simple and robust design including a retracting mechanism capable of resetting the driver with only minimal loss of drive energy. Further, the fastener driving apparatus should be portable in nature, inexpensive to produce, robust, and should be capable of driving the fastener into the workpiece in a single stroke.

SUMMARY OF THE DISCLOSURE

In view of the foregoing disadvantages inherent in the prior art, the general purpose of the present disclosure is to provide a fastener driving apparatus that is configured to include all the advantages of the prior art, and to overcome the drawbacks inherent therein.

Accordingly, an object of the present disclosure is to provide a fastener driving apparatus employing an anvil retracting mechanism that greatly reduces or eliminates consumption of drive energy and facilitates rapid fastener drive speed into a substrate.

Another object of the present disclosure is to provide a fastener driving apparatus that is portable in nature and is capable of providing more safety to a user.

Yet another object of the present disclosure is to provide a fastener driving apparatus that is capable of driving a fastener into a workpiece in a single stroke and is capable of increasing efficiency of the fastener driving apparatus.

Still another object of the present disclosure is to provide a fastener driving apparatus that is capable of minimizing reactionary force generated during fastener driving operation.

Still another object of the present disclosure is to provide a simplified fastener driving apparatus which is capable of being fabricated at a low manufacturing cost, permitting wide-scale adoption by the consumer.

In light of the above objects, a fastener driving apparatus for driving a fastener into a workpiece is disclosed. In an embodiment, the fastener driving apparatus includes a power source, a control circuit, a motor, a first cylinder, a first piston, a linear motion converter, a second cylinder, a second piston, an anvil, a retention element and at least one sensor. The control circuit is electrically coupled to the power source. The motor is electrically coupled to the power source and is responsive to the control circuit.

The first piston is reciprocally movable within the first cylinder to execute a compression stroke and a return stroke. The first piston is configured to define a gas chamber within the first cylinder. The gas chamber is capable of accommodating gas therein. The first piston is operationally coupled to the linear motion converter. The linear motion converter is driven by the motor. The linear motion converter is configured to reciprocally move the first piston within the first cylinder. The first cylinder is pneumatically connected to the second cylinder by way of a gas passageway. The second piston is reciprocally movable within the second cylinder. The anvil is coupled to the second piston. The anvil is capable of striking the fastener to drive the fastener into the workpiece after a sufficient force is applied to overcome the retention force of the retention element. The gas passageway is operationally disposed between the first cylinder and the second cylinder for pneumatically connecting the first cylinder and the second cylinder. The at least one sensor is communicably coupled to the control circuit. The at least one sensor is configured to detect at least one position of the operation cycle and communicate the detected position of the operation cycle to the control circuit. The control circuit is configured to stop an operation cycle of driving the fastener into the workpiece based on the detected position by the at least one sensor.

The control circuit is configured to disconnect the power source from the motor based on a detected point in the operational cycle.

In an embodiment, the retention element is operatively coupled to the second piston, such that the retention element holds the second piston (and anvil) in a first position until a sufficient force is applied on the second piston.

In another embodiment, the retention element is operatively coupled to the first piston, such that the retention element holds the second piston (and anvil) in a first position until the first piston moves a sufficient distance to compress the gas chamber.

In another embodiment, the retention element is electrically coupled to the control circuit such that the retention element holds the second piston (and anvil) in a first position until the first piston moves a sufficient distance to compress the gas chamber at which point the control circuit facilitates release of the retention element.

In another embodiment, the fastener driving apparatus further comprises an air isolation mechanism operationally disposed between the first and second cylinders. In this embodiment, the retention element is operatively coupled to the air isolation mechanism, and retains the air isolation mechanism in a closed position until a sufficient pressure is achieved by the gas in the gas chamber.

During the compression stroke, the first piston is configured to move towards a top dead center of the first cylinder thereby compressing the gas in the gas chamber. After a sufficient pressure is achieved, the force on the retention element overcomes the retaining force of the retention element and the compressed gas is communicated through the gas passageway to the second cylinder, the second piston moves linearly and enables the anvil to drive the fastener into the workpiece. During the return stroke, the first piston is configured to move towards a bottom dead center of the first cylinder, thereby creating a vacuum in the first cylinder between the top dead center of the first cylinder and the first piston. The vacuum created in the first cylinder is communicated to the second cylinder and can be used with or without assistance from a spring or bungee or other retraction means, to cause the second piston and the anvil to retract to retracted positions of the second piston and the anvil.

This aspect together with other aspects of the present disclosure, along with the various features of novelty that characterize the present disclosure, are pointed out with particularity in the claims annexed hereto and form a part of this present disclosure. For a better understanding of the present disclosure, its operating advantages, and the specific objects attained by its uses, reference should be made to the accompanying drawings and descriptive matter in which there are illustrated exemplary embodiments of the present disclosure.

BRIEF DESCRIPTION OF THE DRAWINGS

The advantages and features of the present disclosure will become better understood with reference to the following detailed description and claims taken in conjunction with the accompanying drawings, in which:

Like reference numerals refer to like parts throughout the description of several views of the drawings.

DETAILED DESCRIPTION OF THE DISCLOSURE

Figure 1:
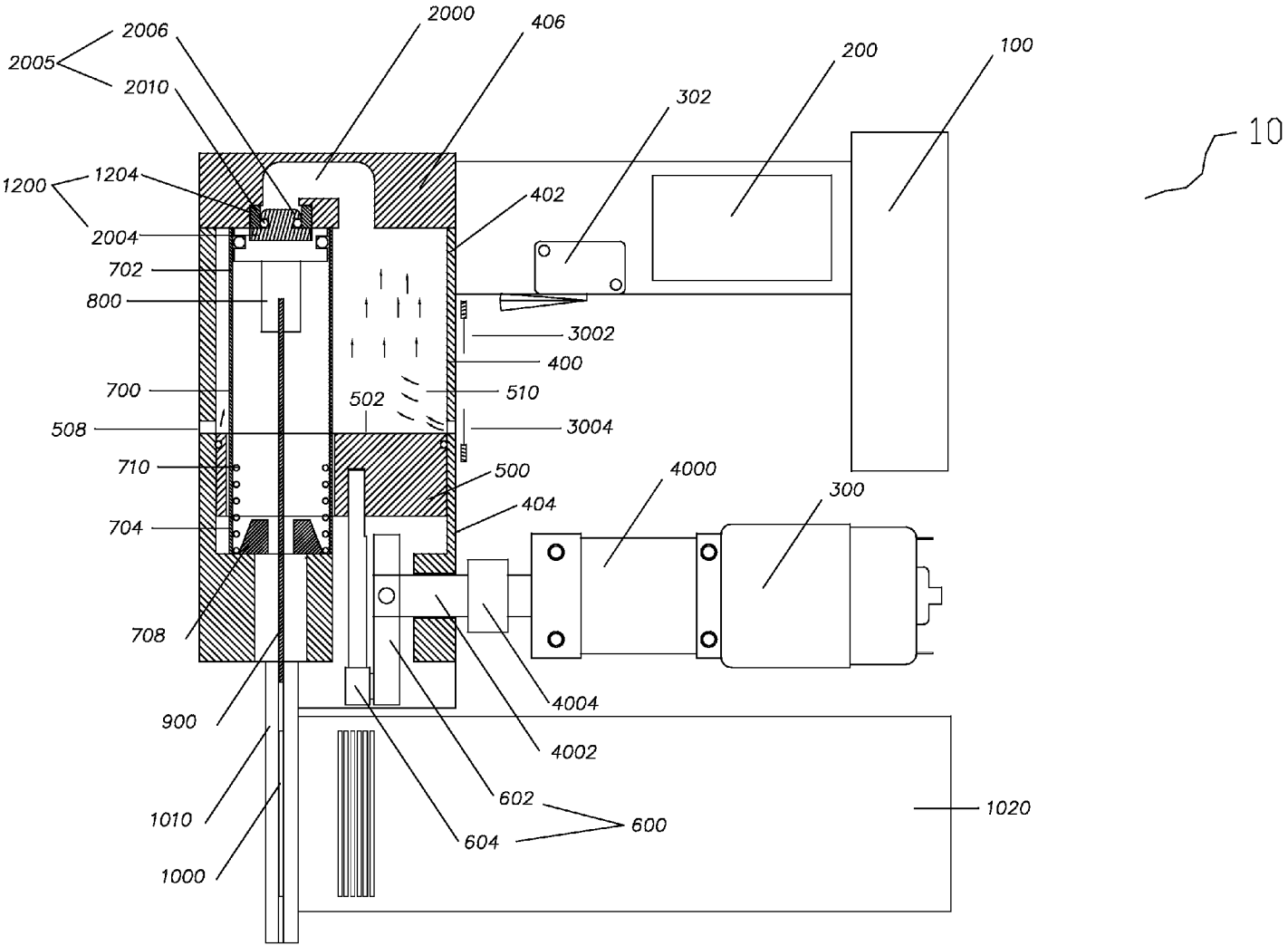
FIG. 1 illustrates a longitudinal cross-sectional view of a fastener driving apparatus depicting an initial stage of an operation cycle of driving a fastener from the fastener driving apparatus and with a magnet and keeper plate retention element retaining a second piston of the apparatus, in accordance with an embodiment of the present disclosure.

The exemplary embodiments described herein detail for illustrative purposes are subject to many variations in structure and design. It should be emphasized, however, that the present disclosure is not limited to a particular fastener driving apparatus as shown and described. It is understood that various omissions and substitutions of equivalents are contemplated as circumstances may suggest or render expedient, but these are intended to cover the application or implementation without departing from the spirit or scope of the claims of the present disclosure.

The terms "first," "second," and the like, herein do not denote any order, quantity, or importance, but rather are used to distinguish one element from another, and the terms "a" and "an" herein do not denote a limitation of quantity, but rather denote the presence of at least one of the referenced item.

The present disclosure provides a fastener driving apparatus for driving fasteners into a workpiece. As used herein, the term "fastener" refers to, but is not limited to, a nail, a staple, and the like. Further, the term "gas" as used herein, refers to, but is not limited to "atmospheric air." Herein, the terms "gas" and "air" are interchangeably used throughout the description. Furthermore, an 'operation cycle' of driving a fastener refers to steps involved in driving the fastener completely into a workpiece from the fastener driving apparatus. The operation cycle may also be termed as a combination of a "compression stroke" and a "return stroke" of a first piston.

The fastener driving apparatus, disclosed in the present disclosure, includes a power source, a control circuit, a motor, a first cylinder, a first cylinder air replenishment mechanism, a first piston, a linear motion converter, a second cylinder, at least one gas passageway, a second piston, an anvil, a retention element and at least one sensor. The first piston is reciprocally movable within the first cylinder to execute a compression stroke and a return stroke. The first piston executes the compression stroke and return stroke with help of the motor and the linear motion converter. Operation of the motor is further controlled by the control circuit. The gas passageway is configured to pneumatically connect the first cylinder and the second cylinder. The second cylinder is positioned parallel to the first cylinder. In an embodiment, the second cylinder may be disposed within the first cylinder.

During the compression stroke of the first piston in the first cylinder, the first piston is configured to move towards a top dead center of the first cylinder, thereby compressing gas in a gas chamber formed above an upper face of the first piston in the first cylinder to a predetermined pressure or a predetermined stroke of the first piston. In an embodiment where the retention element is operatively coupled to the second piston, compressed gas is communicated through the gas passageway to the second cylinder, and after a sufficient force is applied on the second piston to overcome the force of the retention element, the second piston overcomes the retention element and moves linearly within the second cylinder. The anvil coupled to the second piston also moves linearly with the movement of the second piston and strikes the fastener, thereby driving the fastener into the workpiece.

In an embodiment where the retention element is operatively coupled to the first piston, compressed gas is communicated through the gas passageway to the second cylinder, such that the retention element holds the second piston (and anvil) in a first position until the first piston moves a sufficient distance to compress the gas chamber, after which distance the first piston releases the retention element and the second piston moves linearly within the second cylinder. The anvil coupled to the second piston also moves linearly with the movement of the second piston and strikes the fastener, thereby driving the fastener into the workpiece.

In an embodiment where the retention element is electrically coupled to the control circuit, compressed gas is communicated through the gas passageway to the second cylinder, such that the retention element holds the second piston (and anvil) in a first position until the first piston moves a sufficient distance to compress the gas chamber, after which distance the control circuit facilitates release of the retention element and the second piston moves linearly within the second cylinder. The anvil coupled to the second piston also moves linearly with the movement of the second piston and strikes the fastener, thereby driving the fastener into the workpiece.

In an embodiment where the fastener driving apparatus further comprises an air isolation mechanism operationally disposed between the first and second cylinders. In this embodiment, the retention element is operatively coupled to the air isolation mechanism, which mechanism isolates the air from the gas passageway from acting on the full diameter of the second cylinder until a sufficient pressure is developed in the gas chamber. In an embodiment, the force from the compressed air is applied on the air isolation mechanism to overcome the retention force. In another embodiment either the first piston or the control circuit releases the retention element, thus allowing the force from the compressed air to overcome the retention force. Compressed gas is thereafter communicated through the gas passageway to the second cylinder, causing the second piston to move linearly within the second cylinder. The anvil coupled to the second piston also moves linearly with the movement of the second piston and strikes the fastener, thereby driving the fastener into the workpiece.

During the return stroke of the first piston in the first cylinder, the first piston is configured to move towards a bottom dead center of the first cylinder. Movement of the first piston towards the bottom dead center of the first cylinder creates a vacuum between the top dead center of the first cylinder and the first piston. The vacuum created in the first cylinder is communicated to the second cylinder and can be used with or without assistance from springs or bungees (or other retraction means) to cause the second piston and the anvil to retract to their positions in which they are retained by the retention element. Further, the fastener driving apparatus becomes ready for driving a next fastener from the fastener driving apparatus. The working mechanism and configuration of the fastener driving apparatus of the present disclosure is described herein in conjunction with FIGS. 1 to 6.

Referring to FIGS. 1 to 6, longitudinal cross-sectional views of a fastener driving apparatus 10 are illustrated. An operation cycle for driving a fastener 1000 from the fastener driving apparatus 10 will be described in conjunction with FIGS. 1 to 6. Referring particularly to FIG. 1, the fastener driving apparatus 10 includes a power source 100, a control circuit 200, a motor 300, a first cylinder 400, a first piston 500, a linear motion converter 600, a second cylinder 700, a second piston 800, an anvil 900, a retention element 1200 and a pair of sensors 3002 and 3004.

The power source 100 is configured to provide power for working of the fastener driving apparatus 10. The power source 100 may be a rechargeable battery, a battery pack, or any other power source such as an AC power supply. The power source 100 is electrically coupled to the control circuit 200. The power source 100 may be electrically coupled to the control circuit 200 by means of wired, wireless means or any other mechanism known in the art.

The control circuit 200 is configured to actuate the power source 100 for initiating the operation cycle for driving the fastener 1000. Similarly, the control circuit 200 is configured to deactivate the power source 100 after completion of the operation cycle. The control circuit 200 may be any of the various control circuits known in the art. In one embodiment of the present disclosure, the control circuit 200 may include a microprocessor, plurality of high power switching elements and control circuit inputs. Further, in another embodiment of the present disclosure, the control circuit 200 may include a limit switch coupled to cams and linkages. Further, the control circuit 200 may be configured to receive input signals from timers, sensors, and the like. Furthermore, the control circuit 200 may also be configured to provide an output signal to an interface, a LED, and the like. Moreover, in one embodiment of the present disclosure, the control circuit 200 may include at least one low battery indicator, a pulse control of motor power, a plurality of communication ports, a status display indicator, a fault lockout protection controller, and the like. In another embodiment of the present disclosure, the control circuit 200 may control the retention element 1200 by activating or deactivating it. The control circuit 200 is configured to control the working of the motor 300 by activating or deactivating it from the power source 100. In a further embodiment, the control circuit 200 can control the operation cycle by controlling the operation of a clutch.

The motor 300 is electrically connected to the power source 100. The motor 300 is further responsive to the control circuit 200. More specifically, the control circuit 200 is configured to direct the power from the power source 100 to the motor 300 for initiating the operation cycle of driving the fastener such as the fastener 1000 into the workpiece. Similarly, the control circuit 200 is configured to disconnect the power from the power source 100 to the motor 300 after completion of the operation cycle. In one embodiment of the present disclosure, the motor 300 may include a dynamic braking system for halting the rotations of the motor 300. Further, in one embodiment of the present disclosure, the fastener driving apparatus 10 may include a switch 302 for directing and disconnecting the power from the power source 100 to the motor 300 through the control circuit 200. More specifically, the switch 302 may be used to control the control circuit 200 for appropriately actuating the starting and stopping of the operation cycle of fastener drive apparatus 10. The switch 302 may be an ON/OFF switch. The motor 300 is configured to impart a reciprocating movement to the first piston 500 in the first cylinder 400. The motor 300 provides the reciprocating movement to the first piston 500 through the linear motion converter 600. The linear motion converter 600 is configured to convert the rotational motion of the motor 300 into linear reciprocating movement of the first piston 500 within the first cylinder 400.

The linear motion converter 600 is driven by the motor 300. Without departing from the scope of the present disclosure, the linear motion converter 600 may be driven by the motor 300 through a speed reduction mechanism 4000. The speed reduction mechanism 4000 is configured to reduce the revolutions per minute (rpm) of the motor 300 depending upon a required speed of reciprocating movement of the first piston 500. In one embodiment of the present disclosure, the speed reduction mechanism 4000 may be a gear reduction mechanism. The speed reduction mechanism 4000 may also comprise a flywheel, gearbox and/or a clutch. The speed reduction mechanism 4000 is connected to the linear motion converter 600 through a shaft 4002. In the present embodiment of the present disclosure, the linear motion converter 600 is shown as a crankshaft mechanism. Herein, the linear motion converter 600 includes a crankshaft 602 and a connecting rod 604 connected to the crankshaft 602.

The crankshaft 602 is coupled to the shaft 4002 that is coupled to the speed reduction mechanism 4000. The speed reduction mechanism 4000 is mounted to a body portion 1100 of the fastener driving apparatus 10. (This mounting is not shown.) The speed reduction mechanism transmits the rotational motion generated by motor 300 to the crankshaft 602 and the connecting rod 604. The body portion 1100 refers to a structural framework on which various components of the fastener driving apparatus 10 may be disposed. An upper end portion of the connecting rod 604 is connected to the first piston 500. In one embodiment of the present disclosure, the upper end portion of the connecting rod 604 is connected to the first piston 500 by means of a piston or wrist pin (not shown). Further, a lower end portion of the connecting rod is connected to the crankshaft 602. The lower end portion of the connecting rod 604 is connected to the crankshaft 602 by means of a pin joint.

Although, in the embodiment of the present disclosure shown in FIG. 1, the linear motion converter 600 is described in accordance with the crankshaft mechanism, the linear motion converter 600 may include other arrangements, such as a linkage arrangement, a rack and pinion arrangement, a lead screw arrangement, a cam arrangement and the like.

Further, the first cylinder 400 of the fastener driving apparatus 10 is defined by an upper end portion 402, a lower end portion 404. The first cylinder may further comprise a cylinder end cap (or top plate) 406. In such an embodiment, the cylinder end cap 406 is configured on the upper end portion 402. The first cylinder 400 may have a volume that is proportional to the amount of energy required for driving the fastener 1000 into the workpiece. In one embodiment of the present disclosure, for driving an 18 gage fastener, the volume of the first cylinder 400 may be around 8 to 12 cubic inches at standard atmospheric temperature and pressure conditions.

The first piston 500 is disposed within the first cylinder 400. The first piston 500 includes an upper face 502. Further, the first piston 500 is configured to define a gas chamber 510 within the first cylinder 400. More specifically, the first piston 500 is configured to define the gas chamber 510 between the upper face 502 of the first piston 500 and the cylinder end cap 406 of the first cylinder 400. The gas chamber 510 is capable of accommodating gas therein. The first piston 500 is configured to reciprocally move within the first cylinder 400 to execute the compression stroke and the return stroke. During the compression stroke, the first piston 500 is configured to move from the lower end portion 404, i.e., Bottom Dead Center (BDC) of the first cylinder 400 to the upper end portion 402, i.e., Top Dead Center (TDC) of the first cylinder 400. Further, during the return stroke, the first piston 500 is configured to move from the upper end portion 402 (TDC) of the first cylinder 400 to the lower end portion 404 (BDC) of the first cylinder 400.

Before starting the compression stroke, the gas chamber 510 may have a volume of the gas stored therein, which is proportional to the amount of energy required for driving the fastener 1000 into the workpiece. In one specific embodiment of the present disclosure, for driving the 18 gage fastener, the gas chamber 510 may have a volume of about 9 to 11 cubic inches, before starting the compression stroke at standard atmospheric pressure and temperature conditions. More specifically, in this embodiment, for driving the 18 gage fastener, the gas chamber 510 may have a volume of about 10 cubic inches at standard atmospheric pressure and temperature conditions. The gas stored in the gas chamber 510 is prevented from flowing out of the gas chamber as the piston moves towards TDC.

The first cylinder air replenishment mechanism is not limited to holes in the side of the first cylinder, and could also be a mechanical or electrical valve, a check valve, or any other gas passageway configured to allow atmospheric air to flow into the gas chamber 510 at or near the beginning of the compression stroke and to limit compressed air from exiting gas chamber 510 when piston 500 is moving towards the top of the compression stroke.

As shown in FIG. 1, the fastener driving apparatus 10 includes holes 508 in the sidewall of first cylinder 400. In one embodiment, the holes 508 are open to allow atmospheric air to flow into gas chamber 510 when the crankshaft 602 rotates to within 30 degrees from bottom dead center. This opening occurs as the piston 500 moves towards BDC past the holes 508, thus allowing the gas chamber 510 to be replenished with the atmospheric air.

Further, the fastener driving apparatus 10 may include at least one sensor such as a first sensor 3002 and a second sensor 3004, configured to detect at least one position of the operation cycle and communicate the detected position of the operation cycle to the control circuit. A first sensor 3002 and a second sensor 3004, may be disposed anywhere within or on the apparatus that facilitates the sensor in determining the operation cycle of the apparatus. In a non-limiting embodiment, a first sensor 3002 and a second sensor 3004 are disposed on the first cylinder 400. More specifically, the first sensor 3002 is disposed on the upper end portion 402 of the first cylinder 400 and the second sensor 3004 is disposed on the lower end portion 404 of the first cylinder 400. The sensors 3002 and 3004 are communicably coupled to the control circuit 200. The sensors 3002 and 3004 are communicably coupled to the control circuit 200 by means of various wired or wireless means known to a person skilled in the art. Further, in an embodiment, the sensors 3002 and 3004 are configured to detect at least one position of the first piston 500. More specifically, the first sensor 3002 is configured to detect at least one position of the first piston 500 when the first piston 500 approaches the TDC of the first cylinder 400. Similarly, the second sensor 3004 is configured to detect at least one position of the first piston 500 when the first piston 500 approaches the BDC of the first cylinder 400. Further, the first sensor 3002 and the second sensor 3004 are configured to communicate the detected position of the first piston 500 to the control circuit 200. Based on the detected position by the sensor 3004, the control circuit 200 is configured to disconnect the power source 100 from the motor 300 to stop the operation cycle. In an embodiment, based on the detected position by the sensor 3002, an electrically-controlled retention means such as an electromagnet or a solenoid, may be operatively coupled to and controlled by the control circuit 200. It will be apparent that at least one sensor of the present disclosure may be configured at any location in or on the apparatus that causes the sensor discern a position of a component or components of the apparatus for determining a position of the operation cycle of the apparatus. In one embodiment, the control circuit 200 is configured to initiate the operation cycle with a compression stroke of the first piston 500. In another embodiment, the control circuit 200 is configured to initiate the operation cycle with a return stroke of the first piston 500.

The sensors 3002 and 3004 may be selected from, but not limited to, one of or a combination of a limit switch, a Hall Effect sensor, a photo sensor, an analog rheostat, a reed switch, a timer and a current or voltage sensor without departing from the scope of the disclosure. The sensors 3002 and 3004 may also include Hall sensors combined with at least one magnet. The sensors 3002 and 3004 are shown as disposed on the upper end portion 402 and the lower end portion 404 in FIG. 1, however this disposition should not be considered limiting.

Further, a gas passageway 2000 is operationally disposed between the first cylinder 400 and the second cylinder 700. The gas passageway 2000 is disposed in a manner such that the gas passageway 2000 communicates gas between the first cylinder 400 and the second cylinder 700. In one embodiment of the present disclosure, the cross sectional area of the gas passageway 2000 is less than 25% of the cross sectional area of the second cylinder 700. The cross sectional area of the gas passageway 2000 may be less than 25% of the cross sectional area of the second cylinder 700 for minimizing force on the retention element 1200 and thereby reducing wear on the fastener driving apparatus 10.

In an embodiment, the apparatus further comprises an air isolation mechanism shown as 2005 disposed between the first cylinder 400 and second cylinder 700, which air isolation mechanism 2005 is configured to assume one of an open and a closed position. The air isolation mechanism 2005 is configured to define a gas passageway between the first cylinder 400 and second cylinder 700 when the air isolation mechanism is in an open position and to close the gas passageway when the air isolation mechanism is in a closed position. In an embodiment, the air isolation mechanism 2005 includes a spool 2006 and an o-ring 2010. The spool 2006 may be mechanically coupled to the second piston 800.

The second cylinder 700 is pneumatically connected to the first cylinder 400 via the gas passageway 2000 and/or air isolation mechanism 2005. The second cylinder 700 is positioned parallel to the first cylinder 400. In an embodiment, and as shown in the figures, the second cylinder 700 may be disposed within the first cylinder 400. The second cylinder 700 acts as an expansion cylinder, where the compressed gas within the first cylinder 400 is allowed to expand after the compression stroke of the first piston 500 has achieved a level of pressure in the gas chamber, and where the retaining force of the retention element is overcome or the retention element is released. The second cylinder 700 includes a proximal end portion 702, a distal end portion 704 and a top plate 406. Further, a bumper 708 may be disposed in the distal end portion 704 of the second cylinder 700. The bumper 708 is configured to absorb excess energy at the end of an expansion stroke, i.e., when the anvil 900 strikes the fastener 1000. The bumper 708 may be composed of various impact energy absorbing materials, such as an elastomer, and the like.

The second piston 800 is disposed within the second cylinder 700. The second piston 800 is configured to reciprocally move within the second cylinder 700. The anvil 900 can be coupled to the second piston 800 by means of a connector The anvil 900 may be secured in a central groove of the piston 800 by use of suitable means, such as a press fit pin, a nut and bolt arrangement, a rivet, a weld, and the like known in the art. Further, in one embodiment of the present disclosure, the piston 800 and the anvil 900 may also be configured as a single unit.

The anvil 900 is configured to reciprocally move along with the second piston 800. The anvil 900 is capable of linearly moving within the second cylinder 700 and a fastener guide 1010. Further, the anvil 900 is capable of striking the fastener 1000 to drive the fastener 1000 into the workpiece. The fastener guide 1010 is configured to receive the fastener 1000 from a fastener supply mechanism 1020.

Further, in one embodiment of the present disclosure, the second cylinder 700 may further include a second bumper disposed on the proximal end portion 702 of the second cylinder 700 for absorbing excess energy when the second piston 800 is retracted to its retracted position. Furthermore, in one embodiment of the present disclosure, the second cylinder 700 may include an o-ring or a recess in the top plate 406 for maintaining the second piston 800 and the anvil 900 to their retracted positions (pre-fastener driving positions as shown in FIG. 1). Moreover, in one embodiment of the present disclosure, the second cylinder 700 may include a magnet or electromagnet disposed on the top plate 406 and a piece of magnetic material in the second piston 800 for maintaining the second piston 800 and the anvil 900 to their initial positions. Accordingly, by maintaining the second piston 800 and the anvil 900 in their upper positions and ensuring that there is little or no extra dead volume between the second piston 800 and the top plate 406, maximum efficiency may be achieved as the expansion of the gas after the compression stroke acts directly on the second piston 800. Further, such arrangement precludes any accidental release of the anvil 900 and thereby facilitates more safety to the user.

The fastener driving apparatus 10 further comprises a retention element 1200. The retention element may retain (either directly or indirectly) the second piston 800 and the anvil 900 in their retracted or upper positions until a sufficient air pressure or compression is achieved in the gas chamber 510. Upon achieving this compression, the retention element releases the second piston 800 and the anvil 900 and allows the gas from the gas chamber 510 to accelerate the second piston 800 and anvil 900 in order to drive the fastener. Upon retraction of the second piston 800 and the anvil 900, the retention element again retain the second piston 800 and anvil 900 in their first or initial positions. In an embodiment, the retention element 1200 is operatively coupled to the second piston 800 and the anvil 900 for retaining the second piston 800 and anvil 900 in their upper or retracted positions until a sufficient pressure is achieved in the gas chamber 510. In another embodiment, the retention force exerted by retention element 1200 is reduced by the air isolation mechanism 2005. In another embodiment, the retention element is cooperatively released by the first piston 500. In still another embodiment, the retention element 1200 is released electrically by control circuit 200.

The retention element 1200 is capable of retaining a component of the fastener driving apparatus 10 to which it is operatively coupled in a position until a sufficient pressure is achieved in the gas chamber 510 or until the retention element 1200 is released. The retention element 1200 is further capable of again retaining the component of the fastener driving apparatus after the component returns to a position in which it was originally retained. The retention element 1200 may comprise a permanent magnet, an electromagnet, a mechanical detent, a frictional interference, a solenoid or a combination thereof.

In one embodiment of the present disclosure, the retention element 1200 is characterized by a retention force that drops off nonlinearly or exponentially with distance that the second piston 800 moves away from the retention element 1200. Further, such a retention element 1200 can be configured as snap acting. The snap acting retention element 1200 may be further defined as a retention element in which the force of retention drops off by more then 70% within 10 milliseconds of activation.

In an embodiment of the retention element 1200 being operatively coupled to the second piston 800 and anvil 900, and shown in FIG. 1, the second cylinder 700 may include a magnet 1204 disposed on the top plate 406 and a piece of magnetic material in the second piston 800 as the retention element 1200 for maintaining the second piston 800 and the anvil 900 to their initial positions. When a sufficient force is applied on the second piston 800, such as gas compressed by the first piston, the second piston 800 and anvil 900 break free from the retention element 1200 and travel linearly away from their retracted position and move linearly within the second cylinder 700.

In another embodiment, where the retention element 1200 is coupled to the second piston 800 and anvil 900 by a frictional interference, the retention element may comprise a rubber (or other elastic material) ring that exerts a pressure on at least a portion of the spool 2006 of the second piston 800 when the second piston 800 is at the proximal end portion 702 of the second cylinder 700. When a sufficient force is applied on the second piston 800, such as gas compressed by the first piston, the second piston 800 and anvil 900 break free from the retention element 1200 and travel linearly away from their retracted position and move linearly within the second cylinder 700.

In another embodiment, and also shown in FIG. 1, the retention element 1200 is operatively coupled to the air isolation mechanism 2005. In an embodiment, the air isolation mechanism 2005 comprises a spool 2006 and an o-ring 2010, which o-ring 2010 creates a seal on the inner diameter of the magnet 1204 to isolate the compressed air upon the spool 2006. The retention element 1200 is capable of holding the air isolation mechanism 2005 in a closed position until a sufficient force is applied on the air isolation mechanism 2005 to cause the arrangement to break free from the retention element 1200 and assume an open position for allowing air to flow through the gas passageway between the first cylinder 400 and second cylinder 700.

In another embodiment, the retention element 1200 is operated cooperatively with the first piston 500, such that the retention element 1200 retains the second piston 800 and anvil 900 in a position until the first piston 500 moves a sufficient distance from BDC of the first cylinder 400. In a preferred embodiment, such sufficient distance is a distance that compresses the gas chamber 510 by a ratio of at least 3:1. In an exemplary embodiment, the retention element 1200 comprises a lever that extends into the first cylinder 400 and second cylinder 700, which lever retains the second piston 800 and anvil 900 in a position. The lever may extend into a cut-out portion of the second piston 800 or an aperture (not shown) on the front face 802 of the second piston 800. When the first piston 500 exerts a sufficient force on the lever, the lever may pivot, thus releasing the second piston 800 and anvil 900 from the retention force of the lever and allow the second piston 800 and anvil 900 to move linearly within the second cylinder 700. The lever may pivot back to its initial position after releasing the second piston 800, either by a counterweight disposed in the lever or by the force of the vacuum that is created in the second cylinder 700, such that it may retain the second piston 800 and anvil 900 in a position again.

In another embodiment, the retention element 1200 is an electrically controlled retention mechanism (such as a solenoid or an electromagnet) which retains the second piston 800 and the anvil 900 in a first position. When the first piston 500 moves sufficiently to compress the gas in the gas chamber 510 by a ratio of at least 3:1, the control circuit 200, electrically controls the retention element 1200 such that the retention element releases the second piston 800 and anvil 900 from the retention force and such that the second piston 800 and anvil 900 move linearly within the second cylinder 700.

An exemplary embodiment of the operation cycle of the fastener driving apparatus 10 is shown in a progressive manner in FIGS. 1 to 6, and will now be described with reference to FIGS. 1 to 6.

Referring again to FIG. 1, an exemplary embodiment of a first stage of the operation cycle of the fastener driving apparatus 10 is shown. At this stage of the exemplary embodiment of the operation cycle, the first piston 500 is at the BDC of the first cylinder 400, and the second piston 800 and the anvil 900 are at the proximal end portion 702 of the second cylinder 700, the retention element 1200 is retaining a component of the fastener apparatus (and shown in FIG. 1 as an exemplary configuration, the retention element 1200 is retaining the second piston 800 and anvil 900) the fastener 1000 is disposed in the fastener guide 1010 and the motor 300 is in an OFF state. Positioning of the second piston 800 and the anvil 900 at the proximal end portion 702 represent 'first positions' of the second piston 800 and the anvil 900. As the first piston 500 is at BDC, the holes 508 in the first cylinder 400 are in the open position. In the open position the atmospheric air fills the gas chamber 510 through the holes 508 in the sidewall of first cylinder 400 as shown by arrows in FIG. 1.

For initiating this embodiment of the operation cycle of the fastener driving apparatus 10, the user may actuate the switch 302. The control circuit 200 actuates the power source 100 to supply power to the motor 300. The motor 300 then drives the linear motion converter 600, which in turn facilitates the first piston 500 to execute the compression stroke. In the embodiment of the apparatus 10 that further comprises an air isolation mechanism 2005, the air isolation mechanism 2005 is in the closed position, isolating the compressed air from the second cylinder 700. In executing the compression stroke, the first piston 500 moves from the lower end portion 404, i.e., BDC of the first cylinder 400 towards the upper end portion 402, i.e., TDC of the first cylinder 400. As the first piston 500 moves towards the TDC, the first piston moves past the air replenishment holes 508 (sealing off the air replenishment mechanism and gas chamber 510 from the atmosphere.) The first piston 500 compresses the gas in the gas chamber 510.

Figure 2:
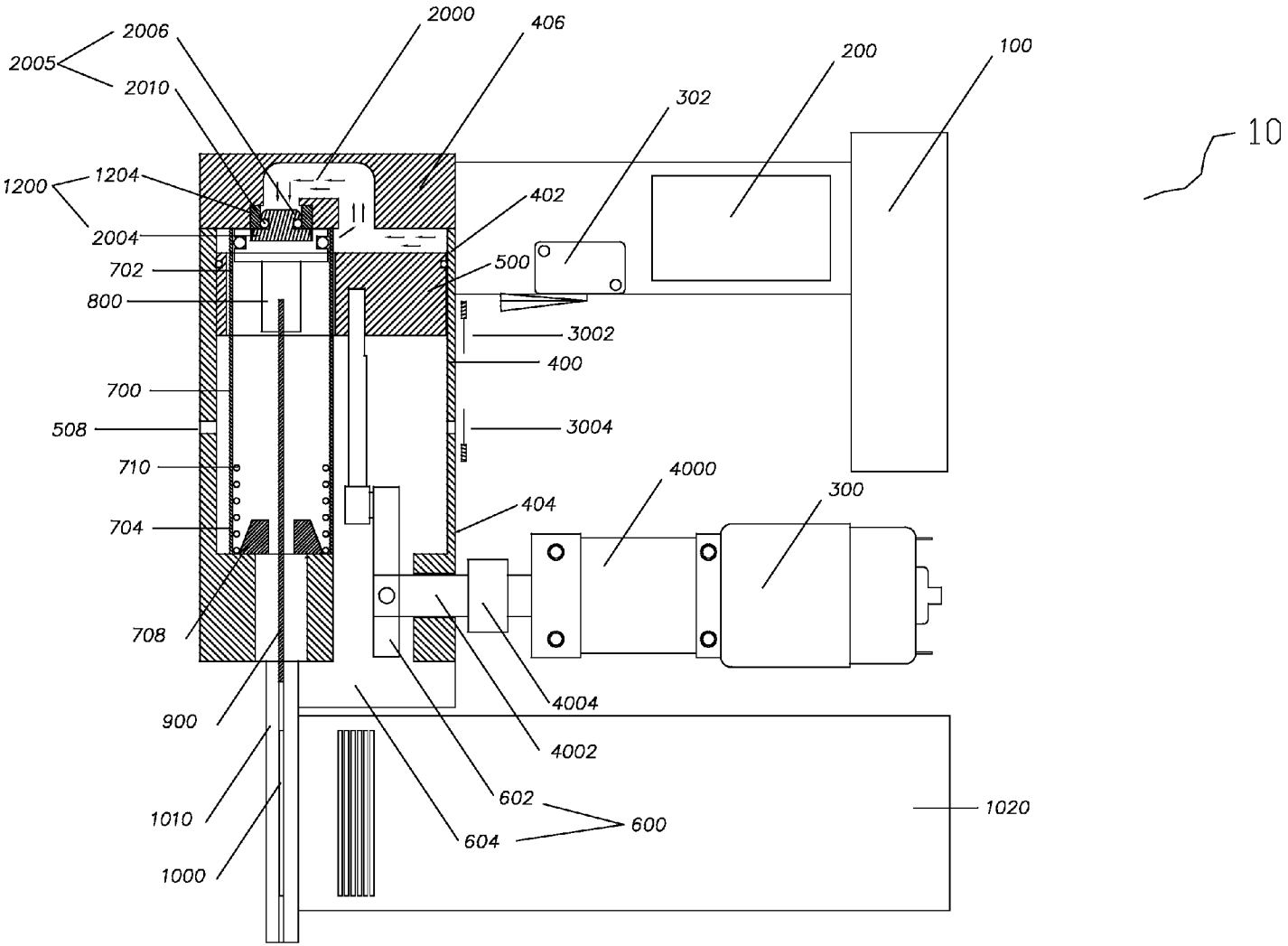
FIG. 2 illustrates a longitudinal cross-sectional view of the fastener driving apparatus depicting compression of gas in a gas chamber, in accordance with an embodiment of the present disclosure.

With or without the air isolation mechanisms 2005, as shown in FIG. 2, as the first piston 500 reaches the TDC of the first cylinder 400, the gas is compressed. In one embodiment of the present disclosure, for driving a standard 18 gage and 2 inches long fastener 1000, the gas in the gas chamber 510 may be compressed to 160 psi (pounds per square inch) with a volume of the compressed gas being approximately one cubic inch. The first piston 500 is configured to compress the gas in the gas chamber 510 in a single rapid linear stroke, i.e., the compression stroke. By compressing the gas in the gas chamber 510 in the single rapid linear stroke, the gas is compressed in a way such that the pressure of the compressed gas exceeds a pressure that will be predicted by the formula $P1V1=P2V2$. Herein, $P1$ and $P2$ represent pressure of the gas and $V1$ and $V2$ represent volume of the gas. Such increase in the pressure may be modeled with a compression exponent greater than 1.0. Compression exponents greater than 1.0 yield higher gas pressures for a given compression ratio than the gas pressure for a compression done in a normal manner, such as in the case of an air compressor tank. More specifically, such a compression exponent allows more energy to be stored in the compressed gas than the energy stored if the compression were done via a normal multi-stroke compressor (in which the heat of compression may be lost to the environment.) This configuration resulted in an unexpected improvement in the efficiency of operation, as the heat of compression is not lost to the environment. Additionally, it resulted in an unexpected reduction in the size of the apparatus since almost 30% less air at atmospheric conditions is required to achieve the desired ending pressure in the one cubic inch volume.

A formula for predicting resultant air pressure with a compression exponent greater than 1.0 may be written as: $P2=P1*(V1/V2)^n$, where $P2$ is pressure of the compressed gas, $V2$ is the final volume of the compressed gas, $V1$ is the volume of the uncompressed gas and n is the compression exponent. For air in an isothermal compression, the compression exponent is 1.0, and for an adiabatic compression the compression exponent is about 1.4. In an embodiment of the present disclosure, as the compression cycle is sufficiently short, the gas in the gas chamber 510 may be compressed to the predetermined pressure at a compression exponent of approximately at least 1.1.

Referring again specifically to the embodiment wherein the fastener driving apparatus 10 comprises an air isolation mechanism 2005. as the first piston 500 reaches towards the TDC of the first cylinder 400 the air pressure builds, acting on retention element 1200.

Figure 3:
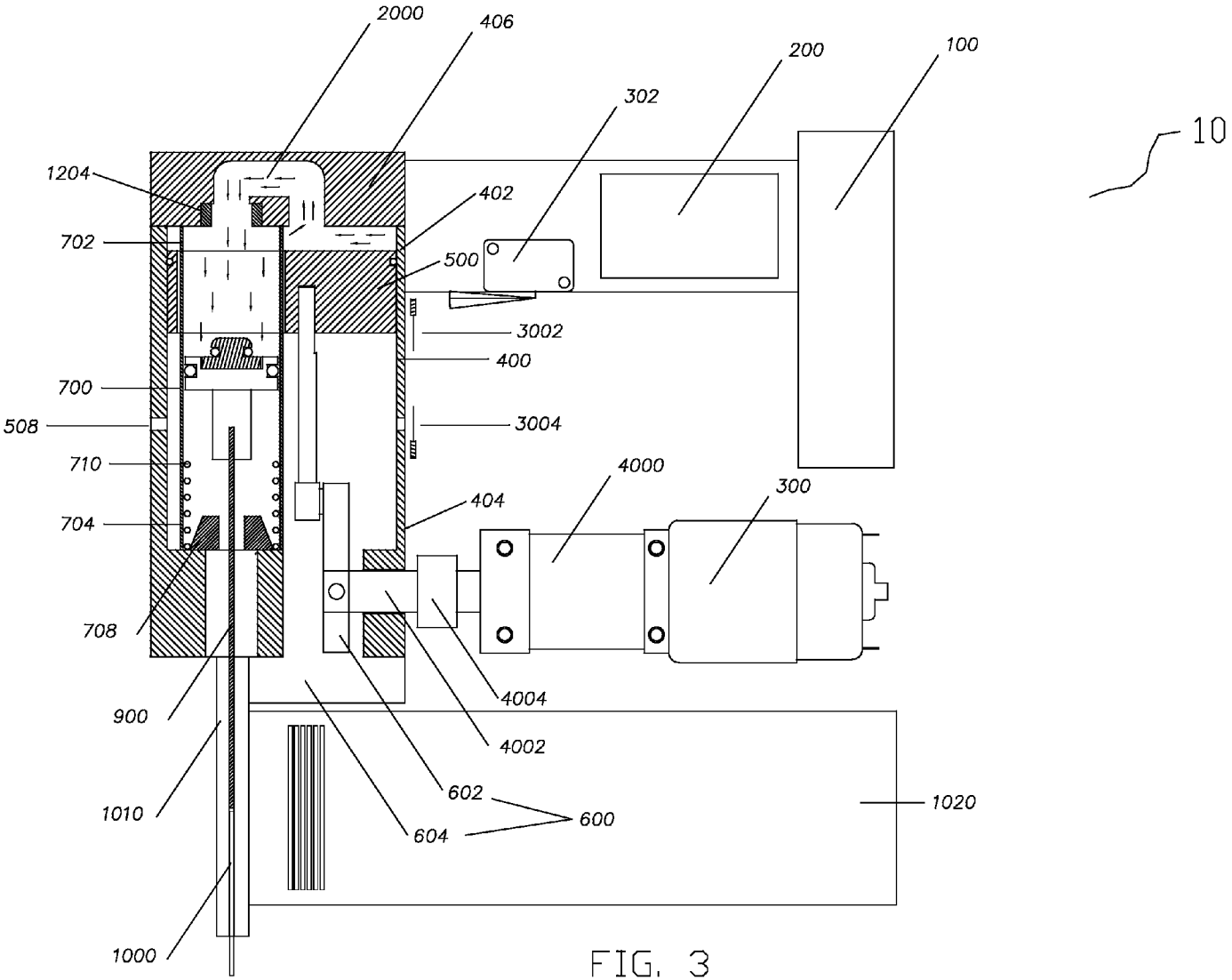
FIGS. 3 and 4 illustrate longitudinal cross-sectional views of the fastener driving apparatus depicting rapidly expanding gas driving a second piston and an anvil in a downward direction after the second piston and anvil have overcome the retention force of a retainer element for driving the fastener into a workpiece, in accordance with an embodiment of the present disclosure.
Figure 4:
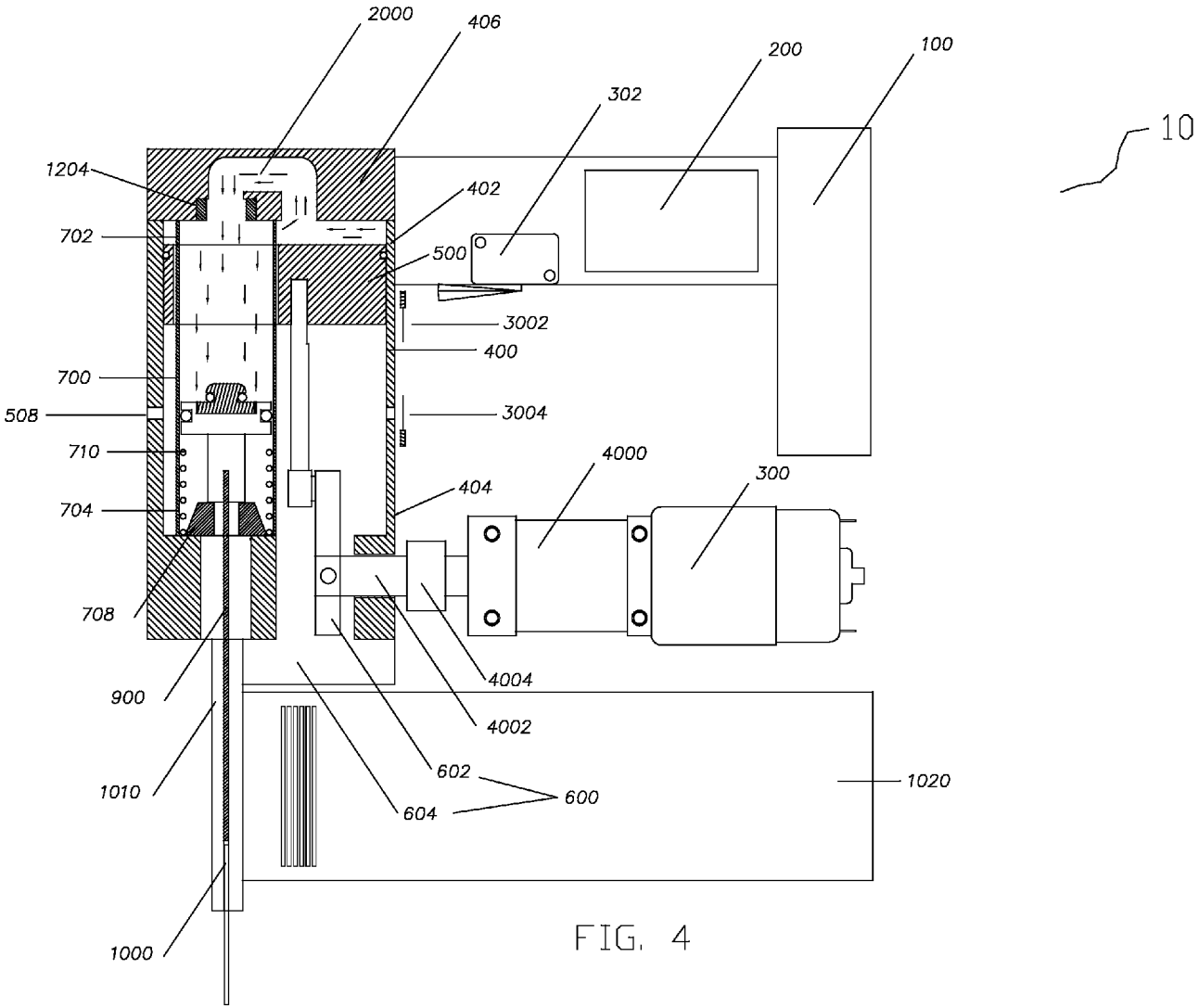

Now referring to FIG. 3 and FIG. 4, next stages of the operation cycle are shown. At or near the completion of the compression stroke, the compressed gas provides a force that is sufficient to overcome the retention force of the retention element 1200, causing the retained component to be released from the retention element 1200. In an embodiment where the retention element 1200 retains the second piston 800 and anvil 900, after a sufficient amount of compressed gas expands onto the second piston 800, the second piston 800 and the anvil 900 overcome the retention force of the retention element 1200 to move linearly in a downward direction. Further, the anvil 900 extends along a longitudinal axis of the second cylinder 700 into the fastener guide 1010 for striking the fastener 1000. The anvil 900, upon striking the fastener 1000, is capable of driving the fastener 1000 into the workpiece as shown in FIG. 4.

In the embodiment where the retention element 1200 retains the air isolation mechanism 2005, after a sufficient amount of compressed gas expands onto the air isolation mechanism 2005, the force on the air isolation mechanism overcomes the retention force of the retention element 1200 and assumes an opens position to allow compressed gas to be communicated to the second cylinder 700, and, in an embodiment, to the full area of the front face 802 (shown, by way of example, in FIGS. 3 and 4) of the second piston 800, through the gas passageway 2000.

In an embodiment where the retention element 1200 is operatively coupled to the first piston 500 and retains the second piston 800 and anvil 900, after a sufficient amount of gas is compressed by the first piston 500, the retention element 1200 is actuated such that it releases the second piston 800 and anvil 900.

In an embodiment where the retention element 1200 is electrically controlled (for example, as a solenoid or an electromagnet), after a sufficient amount of gas is compressed by the first piston 500, the retention element is actuated such that the retained component is released.

As the compressed gas from the first cylinder 400 is rapidly communicated to the second cylinder 700 through the gas passageway 2000 and the retention force of the retention element 1200 on the second piston 800 has been released, the compressed gas from first cylinder 400 is communicated to the second cylinder 700, yielding a rapid acceleration of the second piston 800 and the anvil 900 in the downward direction. Such rapid acceleration of the second piston 800 and the anvil 900 results in a quick fastener drive stroke with a low reaction force as the linear movement of the anvil 900 through the fastener guide 1010 drives the fastener. Further, the excess kinetic energy not used to drive the fastener is absorbed by the bumper 708 upon impact of second piston 800.

Further, excess gas in the second cylinder 700 may be vented to the atmosphere. The excess gas in the second cylinder 700 may be vented to the atmosphere by through, in an embodiment, vents disposed on the second cylinder 700, or on hollow portions of the second piston 800, which hollow portions may be apertures that extend the height of the piston, for allowing gas to flow therethrough. Furthermore, in the case that the movement of the second piston 800 is impeded to any extent (such as a fastener jamb), such venting releases the pressure on the second piston 800 and the anvil 900, thus providing safety to the user.

Figure 5:
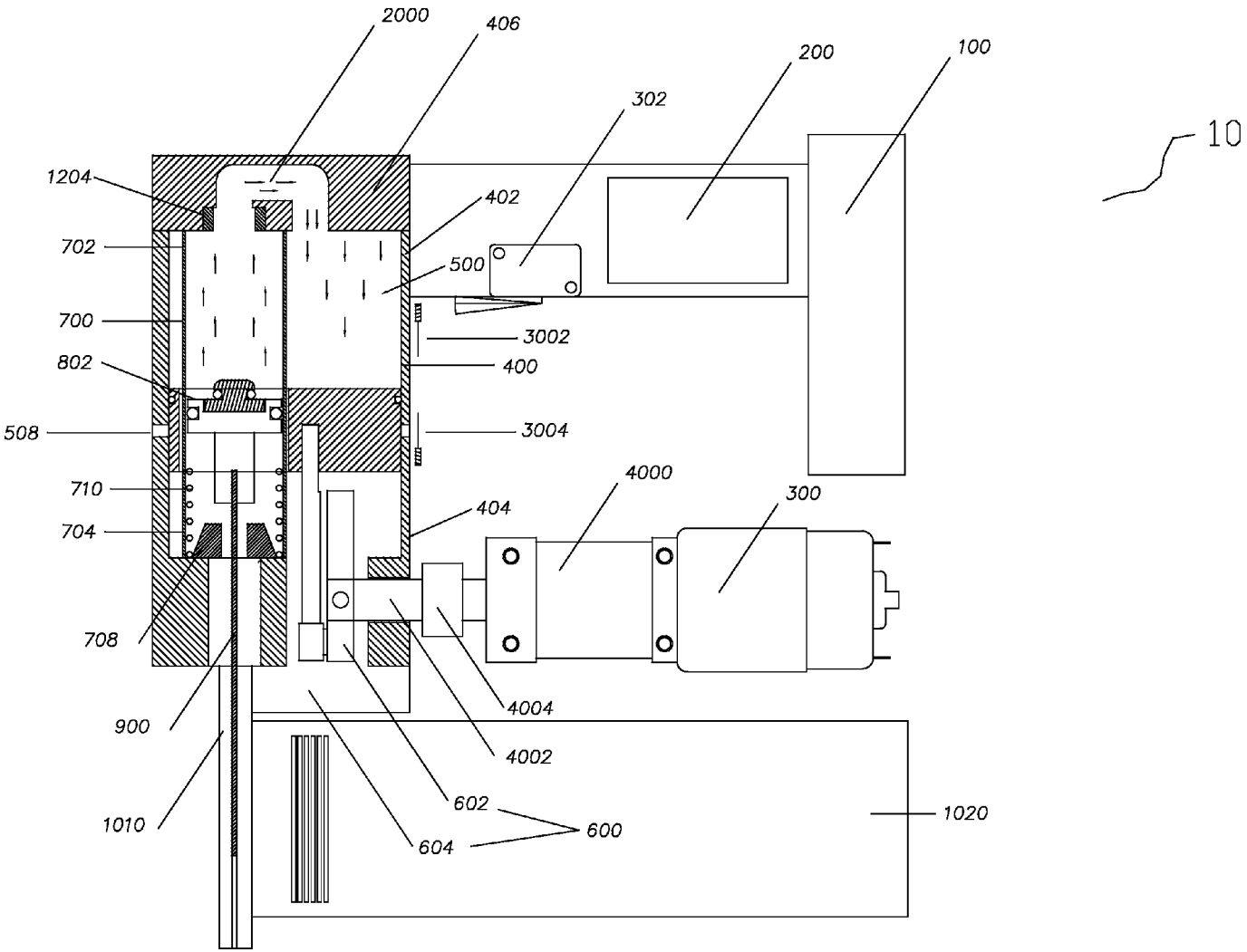
FIG. 5 illustrates a longitudinal cross-sectional view of the fastener driving apparatus depicting a first piston performing a return stroke to generate vacuum in a first cylinder and communicating said vacuum to the second cylinder for retracting the second piston and the anvil to their retracted positions, in accordance with an embodiment of the present disclosure.

After the fastener 1000 is fully driven into the workpiece, due to continuous rotation of the motor 300, the first piston 500 is configured to execute the return stroke, as shown in FIG. 5. During the return stroke, the first piston 500 moves downwardly from the upper end portion 402, i.e., the TDC of the first cylinder 400 towards the lower end portion 404, i.e., the BDC of the first cylinder 400. With the movement of the first piston 500 from TDC toward BDC, a vacuum is created between the first piston 500 and second piston 800. More specifically, the vacuum is created between the upper face 502 of the first piston 500 and the front face 802 of the second piston 800.

Figure 6:
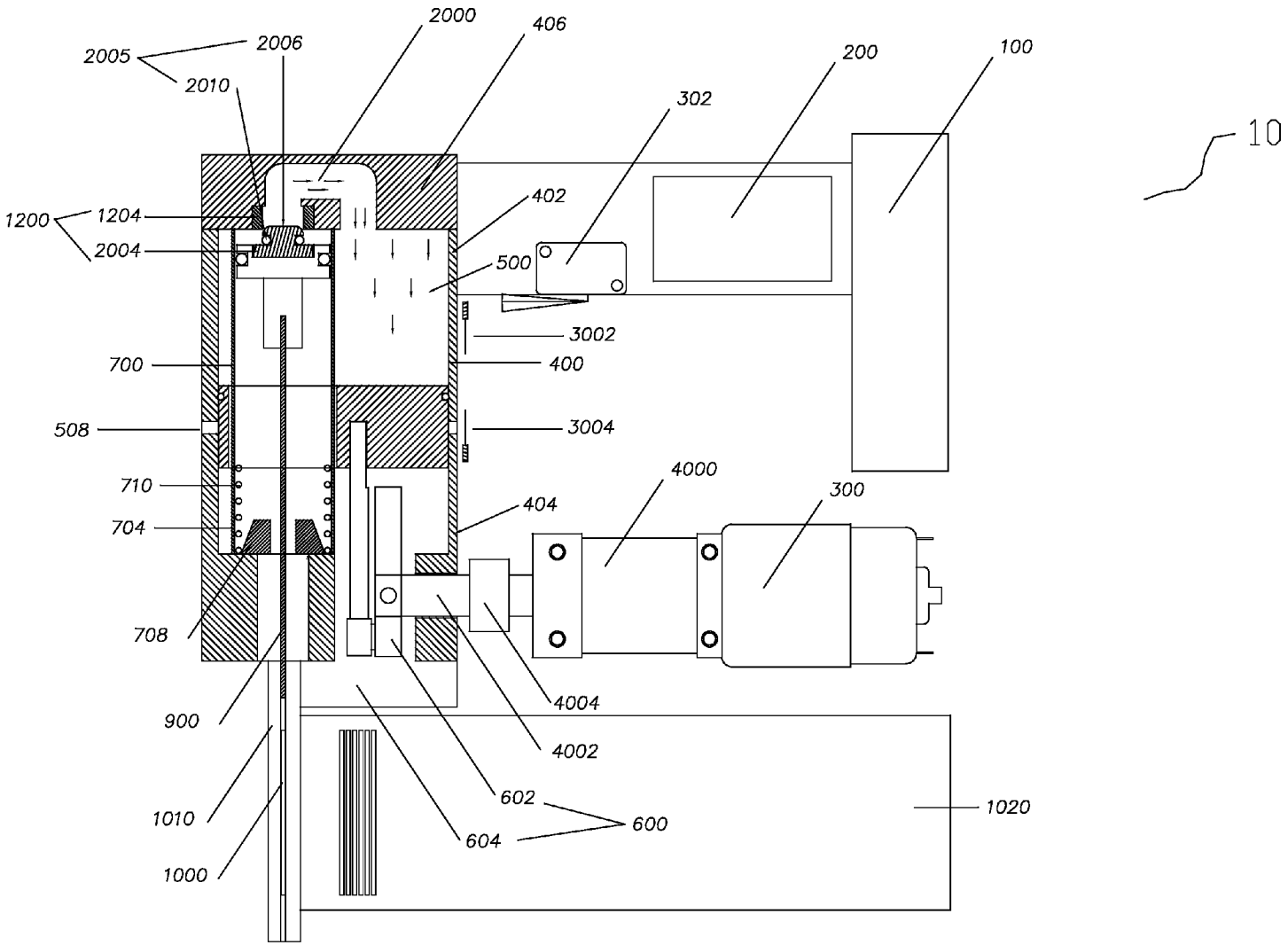
FIG. 6 illustrates a longitudinal cross-sectional view of the fastener driving apparatus depicting nearly retracted positions of the second cylinder and the anvil, in accordance with an embodiment of the present disclosure.

Further, during the return stroke of the first piston 500, when the first piston 500 reaches a predetermined position, the vacuum created within the first cylinder 400 is sufficient such that the second piston 800 and the anvil 900 may be retracted to their initial positions (as shown in FIG. 6).

In another embodiment, additional or alternate retraction means, such as a spring, (shown as 710) may be used to position second piston 800 and anvil 900 in their initial positions. Such additional retraction means may include a mechanical spring, an air spring or an elastomeric element such as a bungee.

The vacuum created in the first cylinder 400 is partially filled by the gas communicated from the second cylinder 700. The vacuum communicated to the second cylinder 700 causes the second piston 800 and the anvil 900 to retract to their retracted positions. Further, as the first piston 500 is configured to reach to the BDC of the first cylinder 400, the second piston 800 and the anvil 900 are returned to their retracted positions, and the retention element 1200 again retains a designated component of the apparatus 10. It would be apparent to those skilled in the art that in the preferred embodiment the second piston 800 and the anvil 900 are retracted to their initial positions without utilizing any drive energy of the fastener driving apparatus 10.

Hence, a person skilled in the art would appreciate that the vacuum generated in the first cylinder 400 acts as the preferred retracting mechanism in the fastener driving apparatus 10 of the present disclosure.

As the second piston 800 and the anvil 900 reach to their initial positions, (and where the apparatus 10 comprises an air isolation mechanism 2005, the air isolation mechanism 2005 is configured to assume the closed position thus isolating the second cylinder 700 from the gas passageway 2005). When the first piston 500 reaches the approximate BDC of the first cylinder 400, the second sensor 3004 detects the presence of the first piston 500 at the BDC, and the control circuit 200 receives the detected position from the second sensor 3004. The control circuit 200 may be configured to disconnect the power source 100 from the motor 300 to stop the operation cycle based on feedback from the second sensor 3004. More specifically, the control circuit 200 may disconnect the power from the power source 100 to the motor 300 so that motor 300 stops actuating the linear motion converter 600 for linearly moving the first piston 500 inside the first cylinder 400. In one embodiment of the present disclosure, the motor 300 may be stopped by means of dynamic braking mechanism. It would be apparent to those ordinary skilled in the art that in this condition, the fastener driving apparatus 10 is in a ready position for performing a next operation cycle of the fastener driving operation. Accordingly, in a single stroke of the first piston 500 the operation cycle of the fastener driving is completed by the fastener driving apparatus 10. Accordingly, with each triggering (i.e., powering of the switch 302), one fastener, such as the fastener 1000, is driven into the workpiece. It would be apparent to those ordinary skilled in the art that in case of continuous driving of fasteners 1000, the motor 300 may be continued as running in order to execute the successive operation cycles in a continuous manner. It may further be appreciated that a clutch 4004 may be disposed between the motor 300 and the linear motion converter 600 to allow the motor to run continuously, with the operational cycle controlled by engaging and disengaging the clutch. This would permit successive operation, with a more rapidly responsive tool as the motor would not have to come up to speed each time it was to perform an operation cycle.

In another embodiment of the present disclosure, the first stage of the operation cycle may be the return stroke of the first piston 500, with the remaining stages of operation cycle occurring in the same respective sequence as described above.

Various embodiments of the present disclosure offer following advantages. The fastener driving apparatus, such as the fastener driving apparatus 10 provides a retracting mechanism that precludes consumption of drive energy of the apparatus and facilitates a fastener to be fully driven into a workpiece. Further, the venting mechanism of the fastener driving apparatus of the present disclosure is capable of providing more safety to a user. Furthermore, the operation cycle does not store energy between cycles and results in added safety for the user. Moreover, the retention mechanism gives a more consistent fastener drive. The fastener driving apparatus of the present disclosure is portable in nature, inexpensive, and simple in construction. Still further, the fastener driving apparatus is capable of minimizing reactionary force and thereby providing more comfort to the user. Additionally, the fastener driving apparatus is capable of driving the fastener into the workpiece in a single stroke.

The foregoing descriptions of specific embodiments of the present disclosure have been presented for purposes of illustration and description. They are not intended to be exhaustive or to limit the present disclosure to the precise forms disclosed, and obviously many modifications and variations are possible in light of the above teaching. The embodiments were chosen and described in order to best explain the principles of the present disclosure and its practical application, and to thereby enable others skilled in the art to best utilize the present disclosure and various embodiments with various modifications as are suited to the particular use contemplated. It is understood that various omissions and substitutions of equivalents are contemplated as circumstances may suggest or render expedient, but such omissions and substitutions are intended to cover the application or implementation without departing from the spirit or scope of the claims of the present disclosure.

What is claimed is:

1. A fastener driving apparatus for driving a fastener into a workpiece, the fastener driving apparatus comprising:

a power source;

a control circuit electrically coupled to the power source;

a motor electrically coupled to the power source and responsive to the control circuit;

a first cylinder;

a first piston reciprocally movable within the first cylinder to execute a compression stroke and a return stroke in an operation cycle of driving the fastener into the workpiece, said first piston defining a gas chamber within said first cylinder, said gas chamber capable of accommodating gas therein;

a linear motion converter driven by the motor and operationally coupled to the first piston for reciprocally moving said first piston within the first cylinder;

a second cylinder pneumatically connected to the first cylinder;

a second piston reciprocally movable within the second cylinder;

a fastener supply mechanism, the fastener supply mechanism comprising at least one fastener therein, an anvil coupled to the second piston, the anvil capable of striking a fastener from the fastener supply mechanism to drive said fastener into the workpiece;

a retention element operatively coupled to the second piston and the anvil, the retention element capable of retaining said second piston and said anvil in a first position until a sufficient force is applied on said second piston or retention element, a gas passageway disposed between the first cylinder and the second cylinder for pneumatically connecting said first cylinder and said second cylinder; and at least one sensor electrically coupled to the control circuit, the at least one sensor configured to detect at least one position of the operation cycle and communicate the detected position of said operation cycle to the control circuit, wherein during the compression stroke, the first piston is configured to move towards a top dead center of the first cylinder for compressing the gas in the gas chamber, the gas passageway communicating the compressed gas to the second cylinder, the retention element retaining the second piston and the anvil in a first position until a sufficient force is applied on said second piston, and upon said sufficient force being applied to said second piston or retention element to overcome the retention force of said retention element, said second piston moving linearly from said first position to a second position, at which second position said anvil may drive a fastener into the workpiece; and wherein during the return stroke the first piston is configured to move towards a bottom dead center of the first cylinder; and wherein the second piston and the anvil are caused to retract to said first position by a retracting means and the retention element thereafter retaining said second piston and anvil in said first position; and wherein during a predetermined point in the operation cycle, based on the at least one detected position by the at least one sensor, the control circuit is configured to stop the operation cycle.

2. The fastener driving apparatus of claim 1, wherein the retracting means includes at least one of a vacuum generated by the movement of the first piston, a mechanical spring, a gas spring or a bungee.

3. The fastener driving device of claim 1, wherein at least one of the second piston or the second cylinder further comprises at least one vent thereon, which at least one vent has at least one side exposed to the atmosphere.

4. The fastener driving apparatus of claim 1, wherein the linear motion converter comprises a crankshaft mechanism.

5. The fastener driving apparatus of claim 1, wherein the linear motion converter is coupled to the motor, said coupling being by way of at least one of a flywheel, a clutch and a gearbox.

6. The fastener driving apparatus of claim 5 wherein the operational cycle is controlled by the clutch.

7. The fastener driving apparatus of claim 1, wherein the retaining force provided by the retention element decreases one of nonlinearly or exponentially as the second piston moves linearly from its first position.

8. The fastener driving apparatus of claim 1, further comprising an air replenishment mechanism wherein said air replenishment mechanism is adapted to allow atmospheric air to flow into the gas chamber after the first piston has retracted to within 45 degrees of the start of the compression stroke and to prevent flow of atmospheric air into the gas chamber when the first piston is more then 45 degrees from the start of the compression stroke.

9. The fastener driving apparatus of claim 1, wherein the retention element is one of at least one of a magnet, an electromagnet, a mechanical detent, frictional interference and a solenoid.

10. A fastener driving apparatus for driving a fastener into a workpiece, the fastener driving apparatus comprising:

a power source;

a control circuit electrically coupled to the power source;

a motor electrically coupled to the power source and responsive to the control circuit;

a first cylinder;

a first piston reciprocally movable within the first cylinder to execute a compression stroke and a return stroke in an operation cycle of driving the fastener into the workpiece, said first piston defining a gas chamber within said first cylinder, said gas chamber capable of accommodating gas therein;

a linear motion converter driven by the motor and operationally coupled to the first piston for reciprocally moving the first piston within the first cylinder;

a second cylinder pneumatically connected to the first cylinder;

a second piston reciprocally movable within the second cylinder;

a fastener supply mechanism, said fastener supply mechanism comprising at least one fastener therein an anvil coupled to the second piston, the anvil capable of striking a fastener from the fastener supply mechanism to drive the fastener into the workpiece;

a gas passageway disposed between the first cylinder and the second cylinder for connecting said first cylinder and said second cylinder;

an air isolation mechanism operationally disposed between the first cylinder and the second cylinder for pneumatically connecting said first cylinder and said second cylinder;

a retention element operatively coupled to the air isolation mechanism, said retention element capable of retaining said air isolation mechanism in a closed position until a sufficient force is applied on said air isolation mechanism, and at least one sensor electrically coupled to the control circuit, the at least one sensor configured to detect at least one position of the operation cycle and communicate the detected position of said operation cycle to said control circuit, wherein during the compression stroke, the first piston is configured to move towards a top dead center of the first cylinder for compressing the gas in the gas chamber, the retention element retaining the air isolation mechanism in a closed position until a sufficient force is applied on said air isolation mechanism, and upon said sufficient force being applied to said air isolation mechanism to overcome the retention force of said retention element, said air isolation mechanism assuming the open position for communicating said compressed gas to the second cylinder, and the second piston and said anvil moving linearly from a first position to a second position, at which second position said anvil may drive the fastener into the workpiece; and wherein during the return stroke the first piston is configured to move towards a bottom dead center of the first cylinder, and wherein during the return stroke of the first piston the second piston and the anvil are caused to retract to said first position by retracting means the retention element thereafter retaining said second piston and anvil in their first positions; and wherein during a predetermined point in the operation cycle, based on the at least one detected position by the at least one sensor, the control circuit is configured to stop the operation cycle.

11. The fastener driving apparatus of claim 10, wherein the retracting means includes at least one of a vacuum generated by the movement of the first piston, a mechanical spring, a gas spring or a bungee.

12. The fastener driving apparatus of claim 10, wherein at least one of the second piston or second cylinder further comprises at least one vent thereon, which at least one vent has at least one side exposed to the atmosphere.

13. The fastener driving apparatus of claim 10, wherein during the compression stroke of the first piston the retention force is reduced after the gas in the gas chamber is compressed by a compression ratio of at least 3 to 1.

14. The fastener driving apparatus of claim 10, further comprising an air replenishment mechanism, wherein said air replenishment mechanism is adapted to allow atmospheric air to flow into the gas chamber after the first piston has retracted to within 45 degrees of the start of the compression stroke and prevent flow of atmospheric air into the gas chamber when the first piston is more then 45 degrees from the start of the compression stroke.

15. A fastener driving apparatus for driving a fastener into a workpiece, the fastener driving apparatus comprising:

a power source;

a control circuit electrically coupled to the power source;

a motor electrically coupled to the power source and responsive to the control circuit;

a first cylinder;

a first piston reciprocally movable within the first cylinder to execute a compression stroke and a return stroke in an operation cycle of driving the fastener into the workpiece, said first piston defining a gas chamber within said first cylinder, said gas chamber capable of accommodating gas therein;

a linear motion converter driven by the motor and operationally coupled to the first piston for reciprocally moving said first piston within the first cylinder;

a second cylinder pneumatically connected to the first cylinder;

a second piston reciprocally movable within the second cylinder;

a fastener supply mechanism, the fastener supply mechanism comprising at least one fastener therein, an anvil coupled to the second piston, the anvil capable of striking a fastener from the fastener supply mechanism to drive said fastener into the workpiece;

a retention element, said retention element capable of retaining said second piston and said anvil in a first position until said first piston moves a sufficient distance to compress the gas chamber by a ratio of at least 3:1, a gas passageway disposed between the first cylinder and the second cylinder for pneumatically connecting said first cylinder and said second cylinder; and at least one sensor electrically coupled to the control circuit, the at least one sensor configured to detect at least one position of the operation cycle and communicate the detected position of said operation cycle to the control circuit, wherein during the compression stroke, the first piston is configured to move towards a top dead center of the first cylinder for compressing the gas in the gas chamber, the gas passageway communicating the compressed gas to the second cylinder, the retention element retaining the second piston and the anvil in a first position until said first piston compresses gas in the gas chamber by a ratio of at least 3 to 1 at which point the retaining force of the retention element is reduced, and upon said reduction said second piston moving linearly from said first position to a second position, at which second position said anvil may drive a fastener into the workpiece; and wherein during the return stroke the first piston is configured to move towards a bottom dead center of the first cylinder, and wherein during the return stroke of the first piston, the second piston and the anvil are caused to retract to said first position by retracting means, the retention element thereafter retaining said second piston and anvil in said first position; and wherein during a predetermined point in the operation cycle, based on the at least one detected position by the at least one sensor, the control circuit is configured to stop the operation cycle.

16. The fastener driving apparatus of claim 15, wherein the retention element is at least one of a sear, a lever, an electromagnet, a magnet, a cam or a solenoid.

17. The fastener driving apparatus of claim 15, wherein at least one of the second piston or second cylinder further comprises at least one vent thereon, which at least one vent has one side exposed to the atmosphere.

18. The fastener driving apparatus of claim 15, further comprising an air replenishment mechanism wherein said air replenishment mechanism is adapted to allow atmospheric air to flow into the gas chamber after the first piston has retracted to within 45 degrees of the start of the compression stroke and to prevent flow of atmospheric air into the gas chamber when the first piston is more then 45 degrees from the start of the compression stroke.

19. The fastener driving apparatus of claim 15, wherein the linear motion converter is coupled to the motor, said coupling being by way of at least one of a flywheel, a clutch and a gearbox.

20. The fastener driving apparatus of claim 19 wherein the operational cycle is controlled by the clutch.

* * * * *